US011024964B2

(12) United States Patent
Zhu

(10) Patent No.: US 11,024,964 B2
(45) Date of Patent: Jun. 1, 2021

(54) ANTENNA SYSTEM AND MOBILE TERMINAL

(71) Applicant: AAC Technologies Pte. Ltd., Singapore (SG)

(72) Inventor: Yufei Zhu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 49 days.

(21) Appl. No.: 16/524,217

(22) Filed: Jul. 29, 2019

(65) Prior Publication Data

US 2020/0044340 A1 Feb. 6, 2020

(30) Foreign Application Priority Data

Aug. 3, 2018 (CN) ..... 201810875750.1

(51) Int. Cl.

| | |
|---|---|
| ***H01Q 5/328*** | (2015.01) |
| ***H01Q 1/24*** | (2006.01) |
| ***H01Q 1/48*** | (2006.01) |

(52) U.S. Cl.

CPC ..... *H01Q 5/328* (2015.01); *H01Q 1/241* (2013.01); *H01Q 1/48* (2013.01)

(58) Field of Classification Search

None

See application file for complete search history.

(56) References Cited

U.S. PATENT DOCUMENTS

2012/0009983 A1* 1/2012 Mow ..... H04B 1/40 455/575.7

* cited by examiner

*Primary Examiner* — Jany Richardson

(74) *Attorney, Agent, or Firm* — W&G Law Group LLP

(57) ABSTRACT

The present disclosure provides an antenna system, including: a metal housing including a radiation frame and a grounded back shell; a circuit board located in the metal housing and including a radio frequency feeding source and a tunable capacitor; and an antenna unit connected to the radio frequency feeding source and configured to be coupled to the radiation frame. A fracture is formed between each of two ends of the radiation frame and the grounded back shell. The tunable capacitor is connected to the radiation frame so as to change an electrical length of the antenna system by switching to different capacitances. Compared with the related art, the antenna system provided by present disclosure, by providing the tunable capacitor as a tuner of the antenna system, not only can achieve that the radiation frequency of the antenna system covers 790-960 MHz and 1710-2690 MHz, but also has good radiation performance.

8 Claims, 10 Drawing Sheets

Frequency

ANTENNA SYSTEM AND MOBILE TERMINAL

TECHNICAL FIELD

The present disclosure relates to the field of antenna technologies, and in particular, to an antenna system and a mobile terminal.

BACKGROUND

In wireless communication devices, there is always a device that radiates electromagnetic energy into space and receives electromagnetic energy from space, and this device is an antenna. The role of the antenna is to transmit a digital or analog signal modulated onto a radio frequency (RF) frequency to a spatial wireless channel, or to receive a digital or analog signal modulated onto a RF frequency from a spatial wireless channel.

Metal frame architectures are mainstream solutions in the mobile phone structure design, which can provide the better protection, aesthetics, thermal diffusion and user experience. However, due to the shielding effect of metal on electromagnetic waves, radiation performance of an antenna will be seriously affected and the gain of the antenna will be reduced.

Therefore, it is necessary to provide a new antenna system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
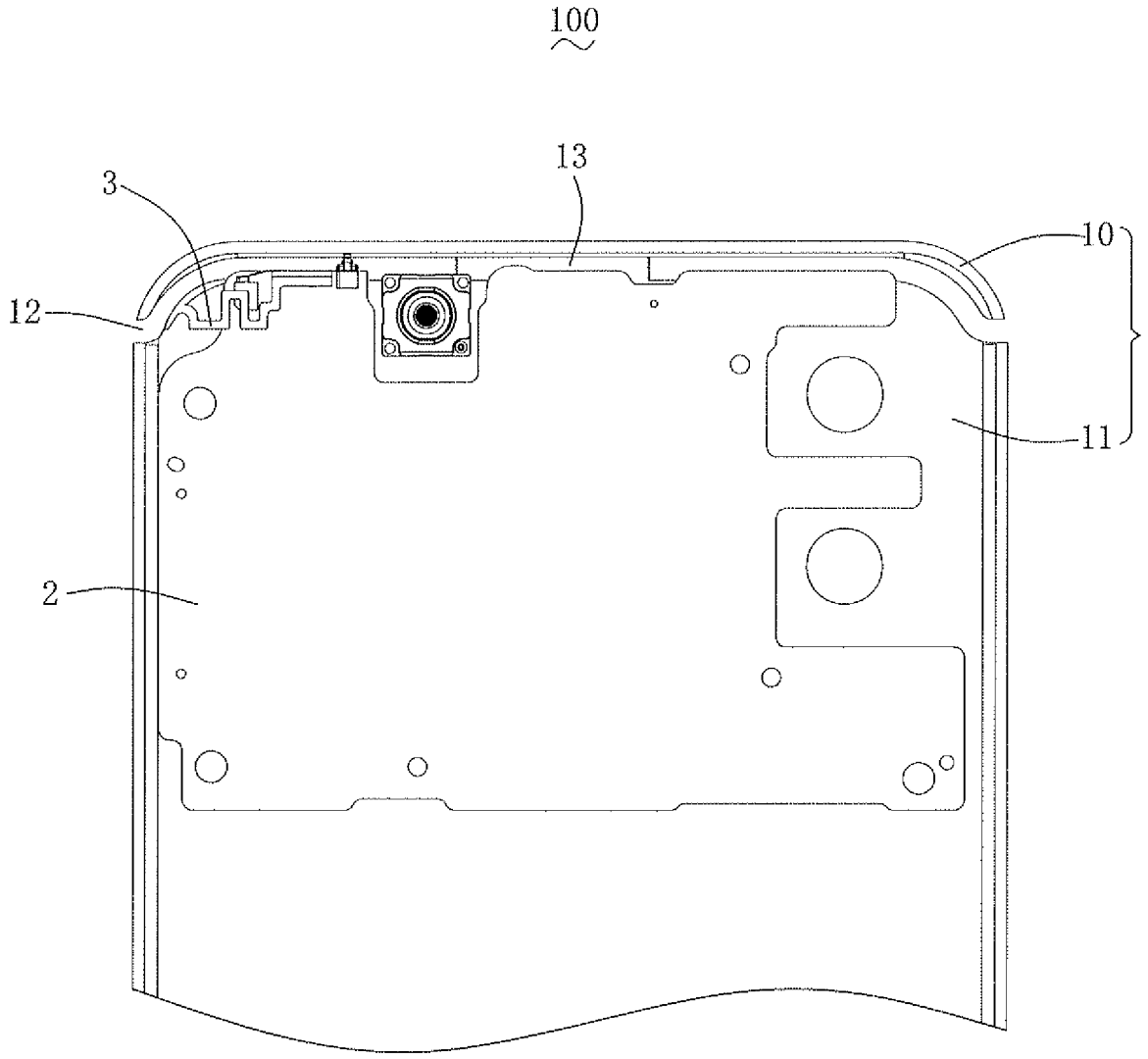
FIG. 1 is a structural schematic diagram of an antenna system according to the present disclosure.
Figure 2:
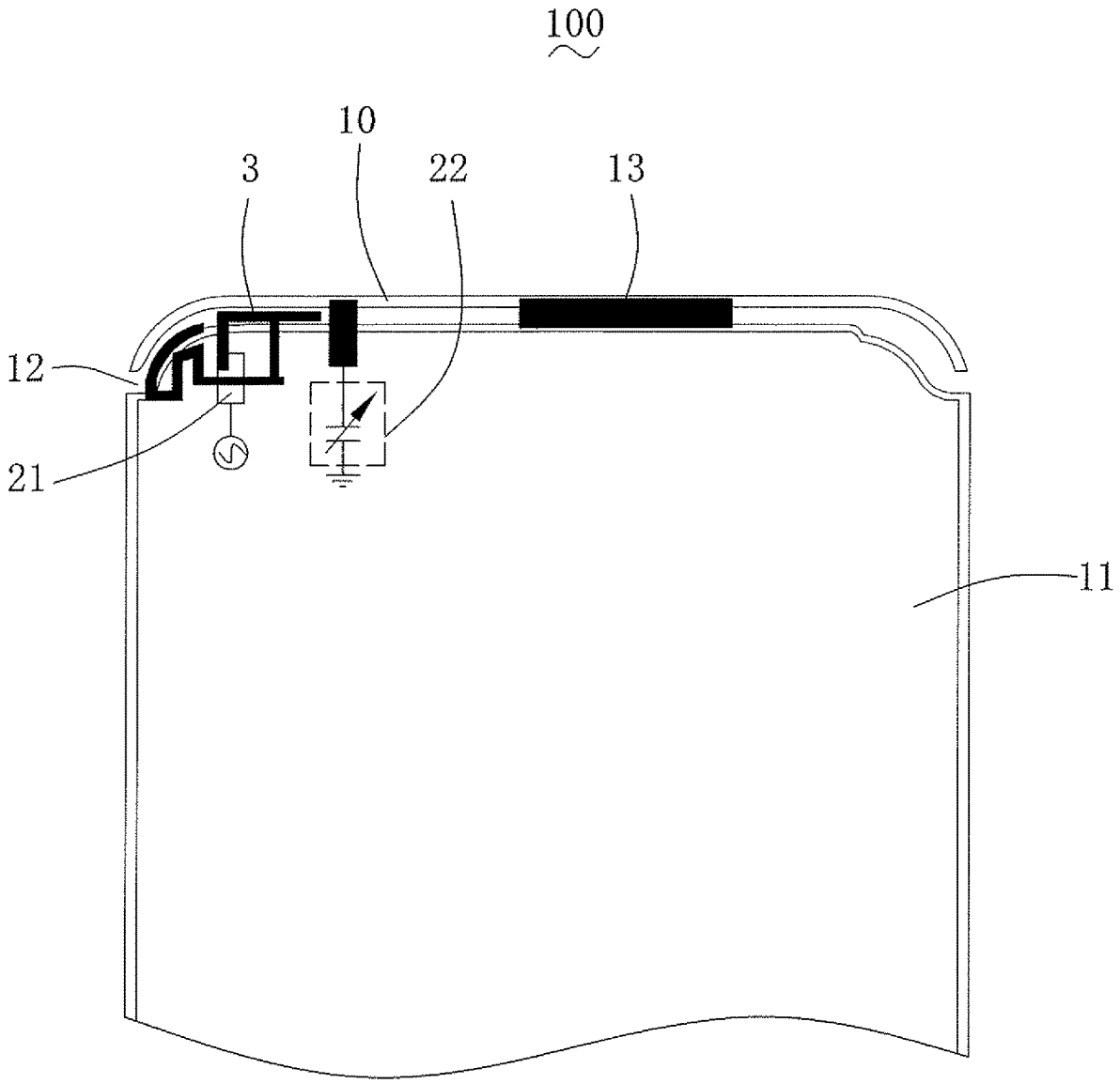
FIG. 2 schematically illustrates a circuit structure of an antenna system according to the present disclosure.

Referring to FIG. 1 and FIG. 2, an embodiment of the present disclosure provides an antenna system 100 which includes a metal housing 1, a circuit board 2 and an antenna unit 3. The circuit board 2 is located in the metal housing 1. The circuit board 2 includes a radio frequency feeding source 21 and a tunable capacitor 22. The metal housing 1 includes a radiation frame 10 and a grounded back shell 11 spaced apart from the radiation frame 10. A fracture 12 is formed between each of two ends of the radiation frame 10 and the grounded back shell 11. The radiation frame 10 and the grounded back shell 11 are connected by a connecting rib 13. The radiation frame 10 is a primary radiator of low frequency.

The antenna unit 3 is connected to the radio frequency feeding source 21 and arranged to be coupled to the radiation frame 10 to serve as a primary radiator of medium-high frequency.

The tunable capacitor 22 is connected to the radiation frame 10. Specifically, the tunable capacitor 22 is connected in series between the radiation frame 10 and the system ground, and the metal back shell 1 can be used as the system ground, such that an electrical length of the antenna system 100 can be changed by switching to different capacitances of the tunable capacitor 22, thereby achieving that the radiation frequency of the antenna system 100 covers 790-960 MHz and 1710-2690 MHz. In a preferred embodiment of the present disclosure, the tunable capacitor 22 has a capacitance ranging from 0.75 pF to 3.1 pF. Depending on different capacitances, the antenna system 100 will operate in different bands, i.e., the antenna system 100 operates in different states.

A case where the antenna system 100 operates in seven different states is taken as an example for detailed description. Refer to Table 1 below for details.

TABLE 1

| State | Capacitance (pF) | Frequency Band |
|---|---|---|
| State 1 | 0.75 | GSM900-TIS/LTE-B7/38/40/41 |
| State 2 | 0.9 | GSM900-TRP/WCDMA-8/LTE-B8 |
| State 3 | 1.05 | G5M850-TIS |
| State 4 | 1.28 | GSM850-TRP/CDMABC0/WCDMA-5/LTE-B5/WCDMA-1/LTE-B1/TD-A |
| State 5 | 1.74 | GSM1900-TIS/TD-F/LTE-B20/LTE-B39 |
| State 6 | 1.96 | GSM1900-TRP/WCDMA-2/LTE-B2 |
| State 7 | 3.1 | GSM1800/WCDMA-4/LTE-B3/4 |

Figure 3:
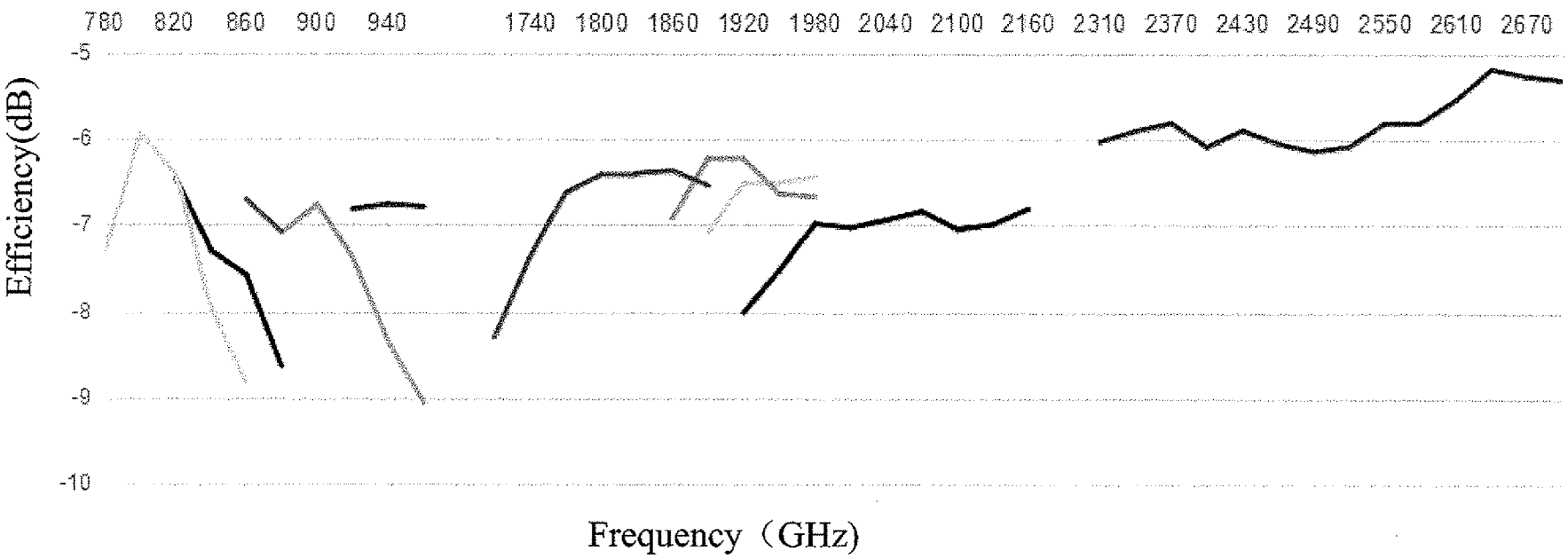
FIG. 3 illustrates a passive efficiency of an antenna system according to the present disclosure.
Figure 4:
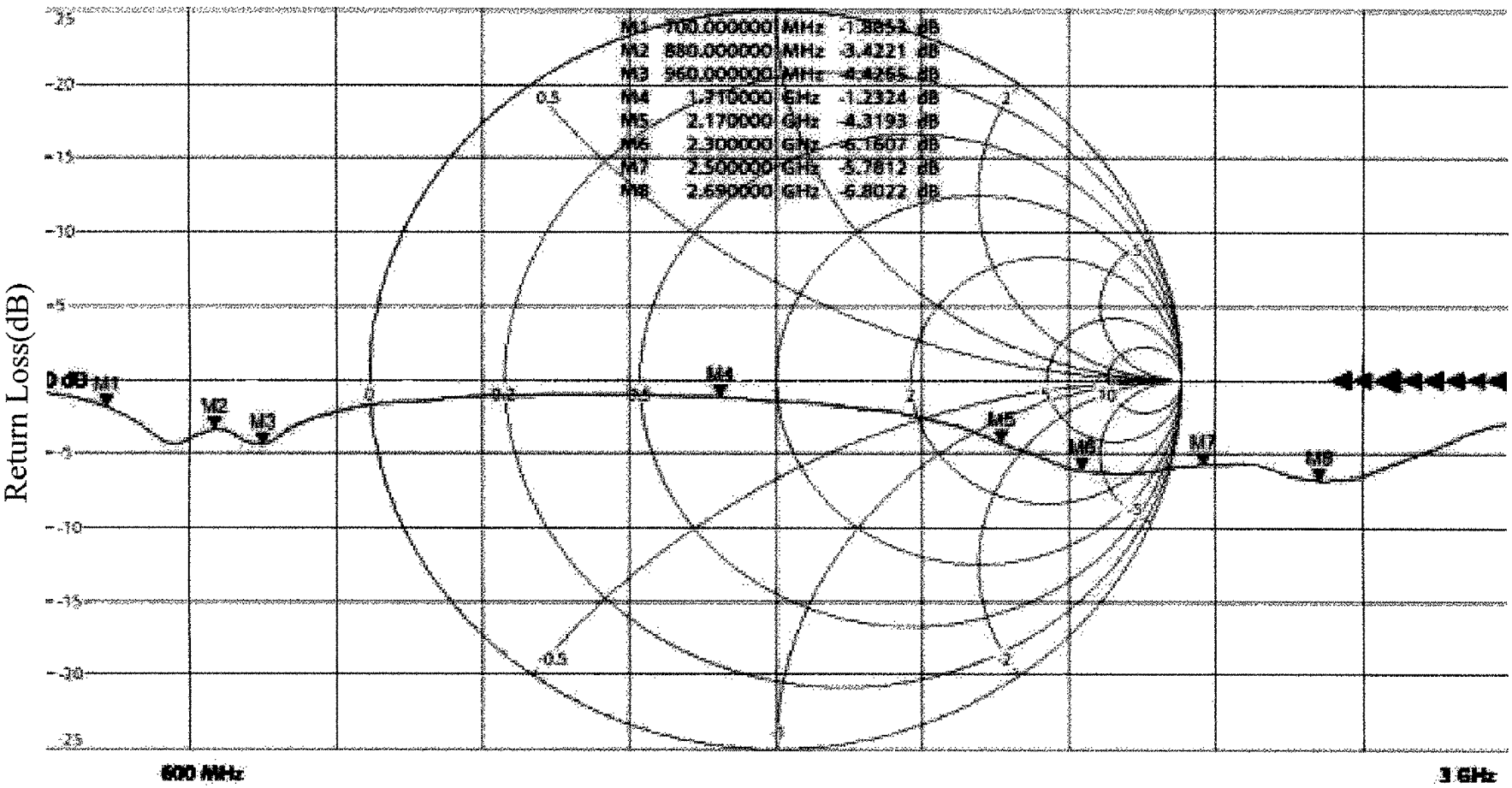
FIG. 4 is a return loss graph of an antenna system according to the present disclosure in state 1.
Figure 5:
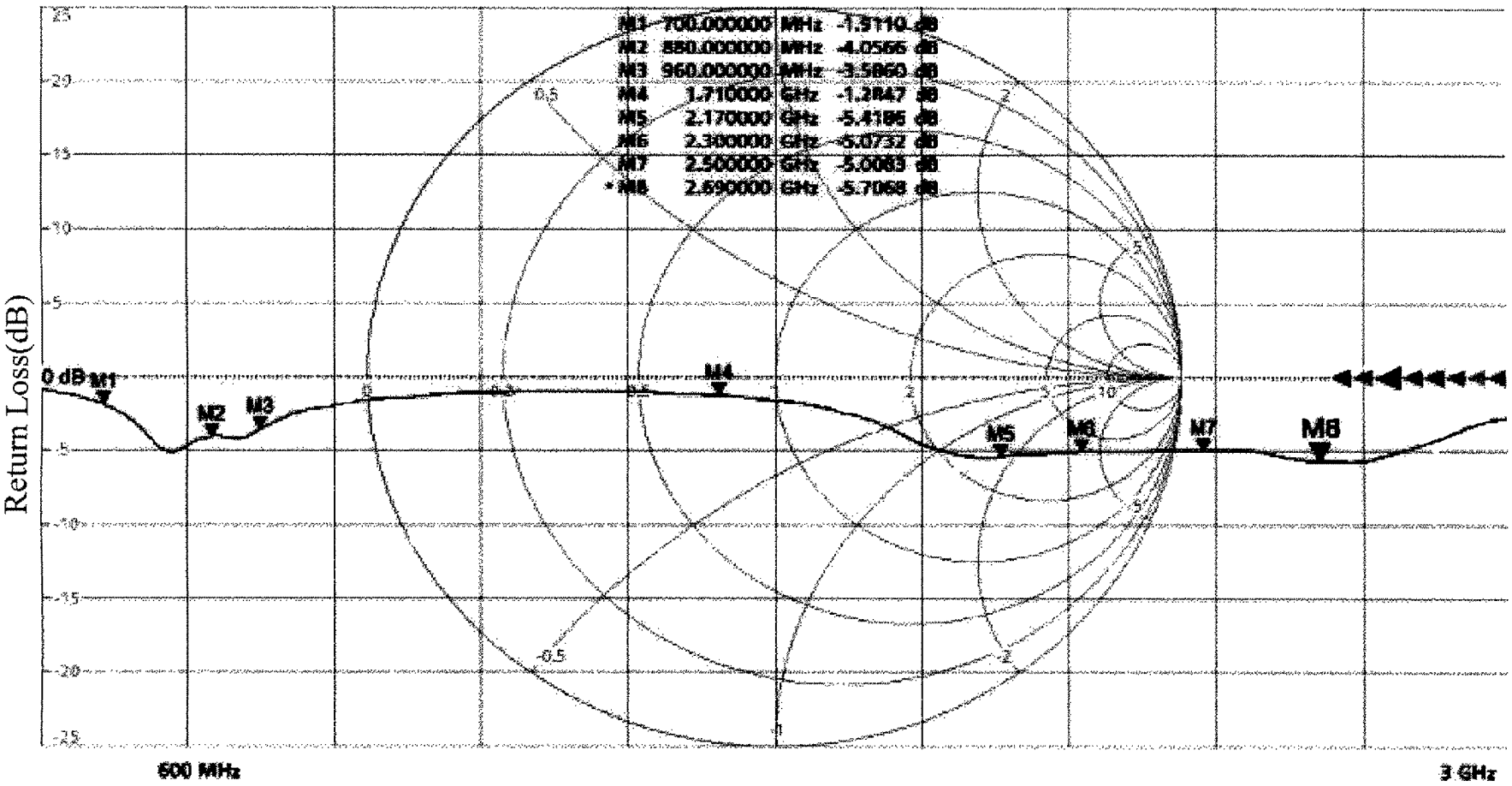
FIG. 5 is a return loss graph of an antenna system according to the present disclosure in state 2.
Figure 6:
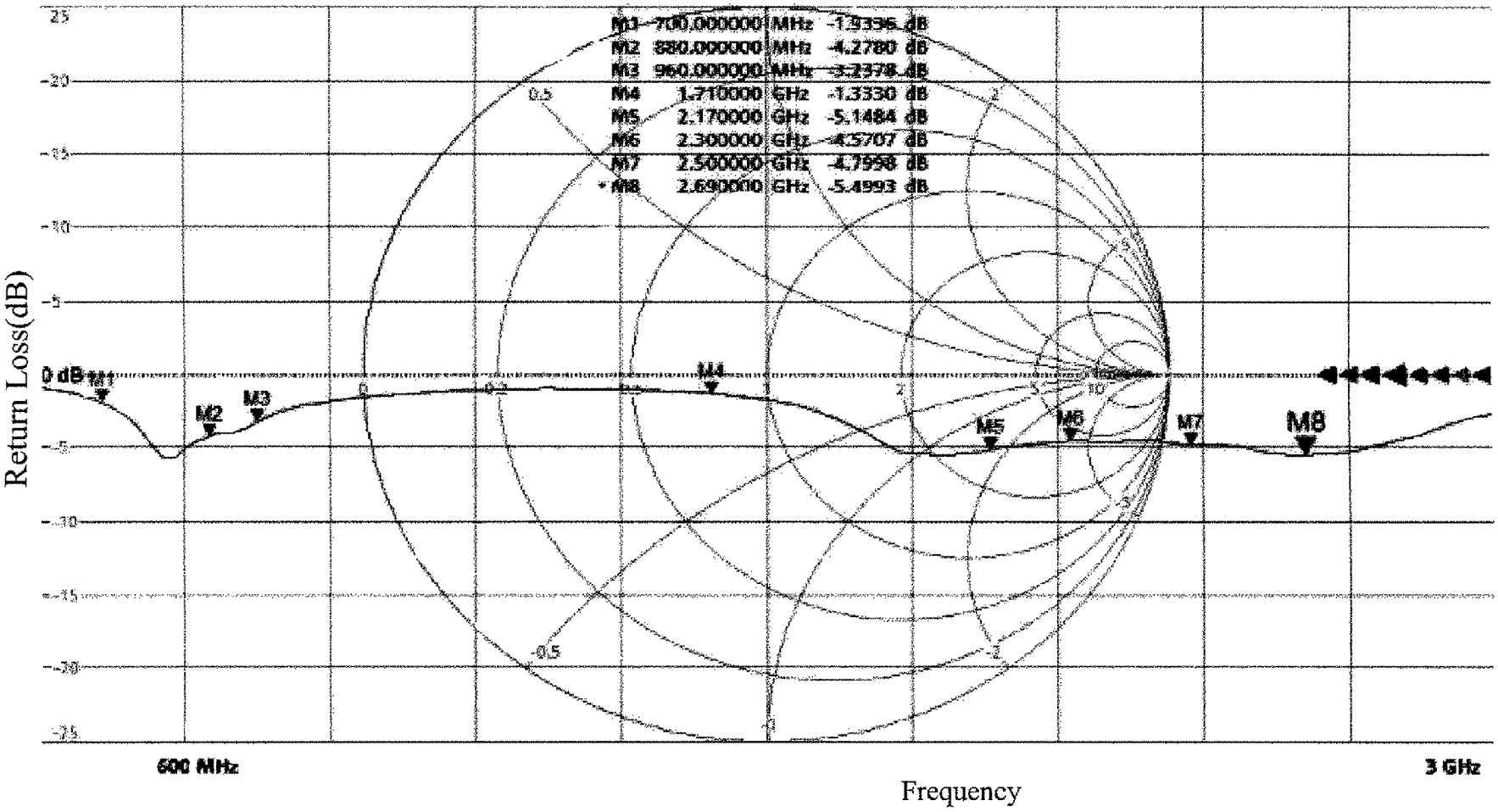
FIG. 6 is a return loss graph of an antenna system according to the present disclosure in state 3.
Figure 7:
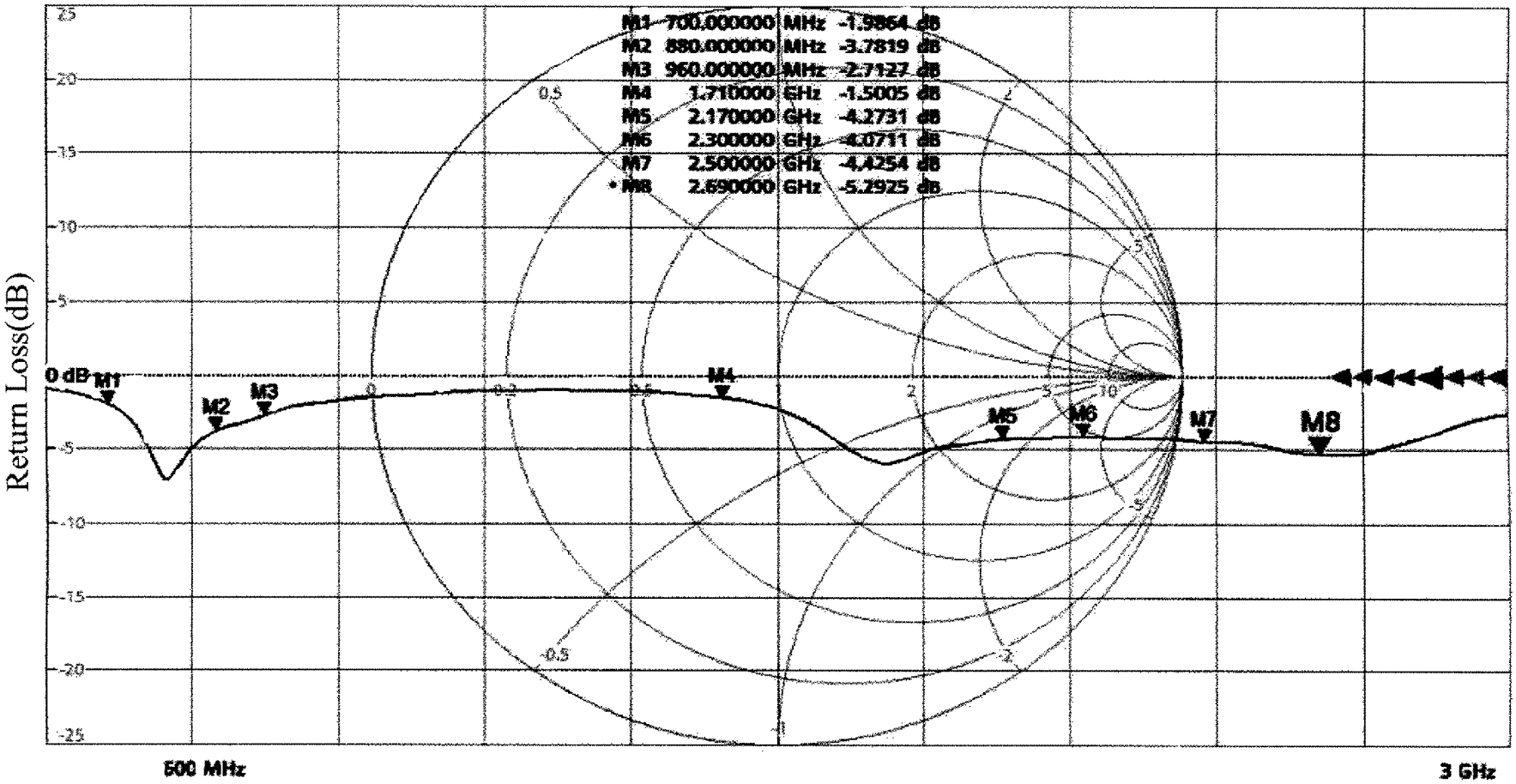
FIG. 7 is a return loss graph of an antenna system according to the present disclosure in state 4.
Figure 8:
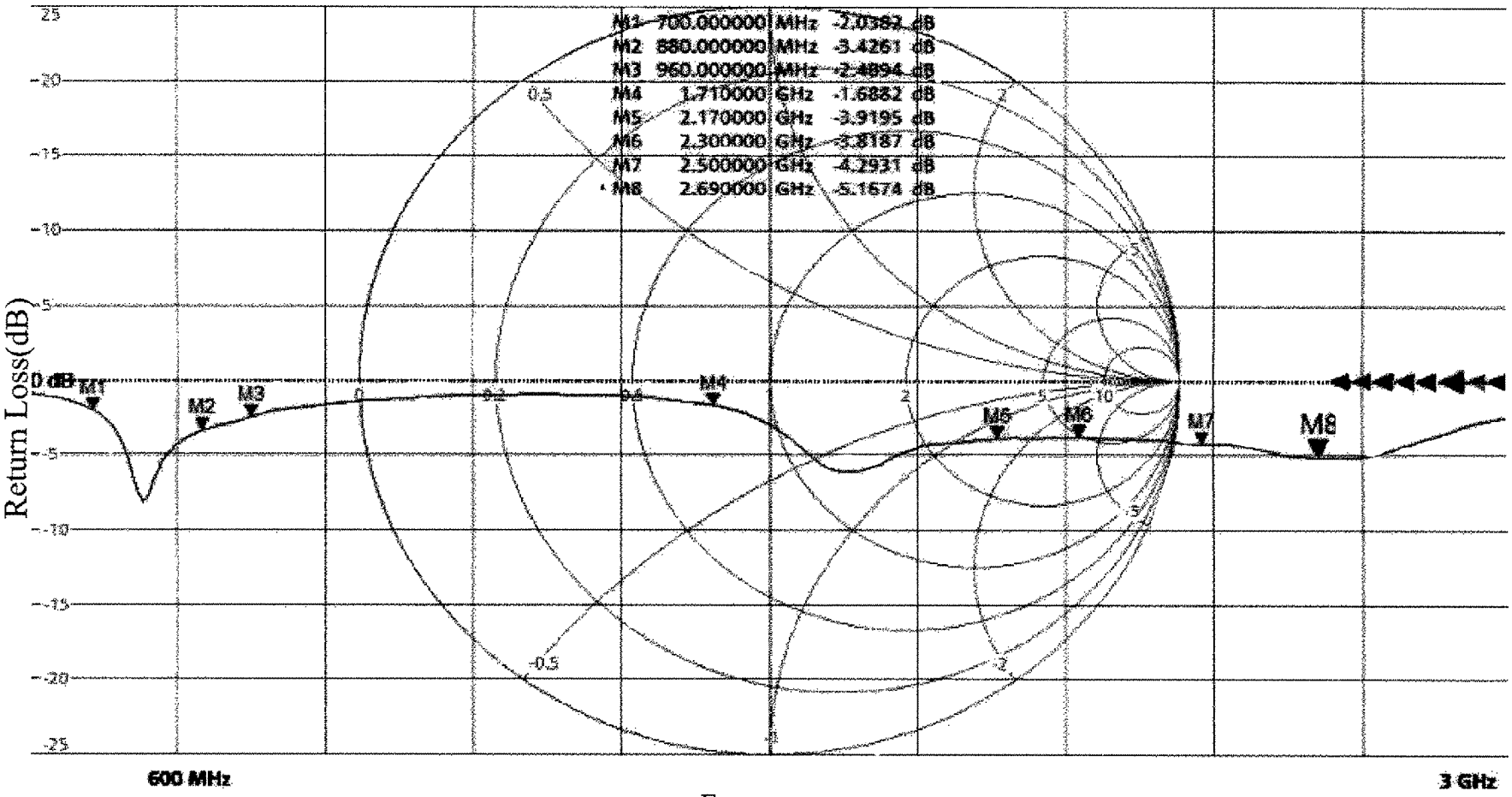
FIG. 8 is a return loss graph of an antenna system according to the present disclosure in state 5.
Figure 9:
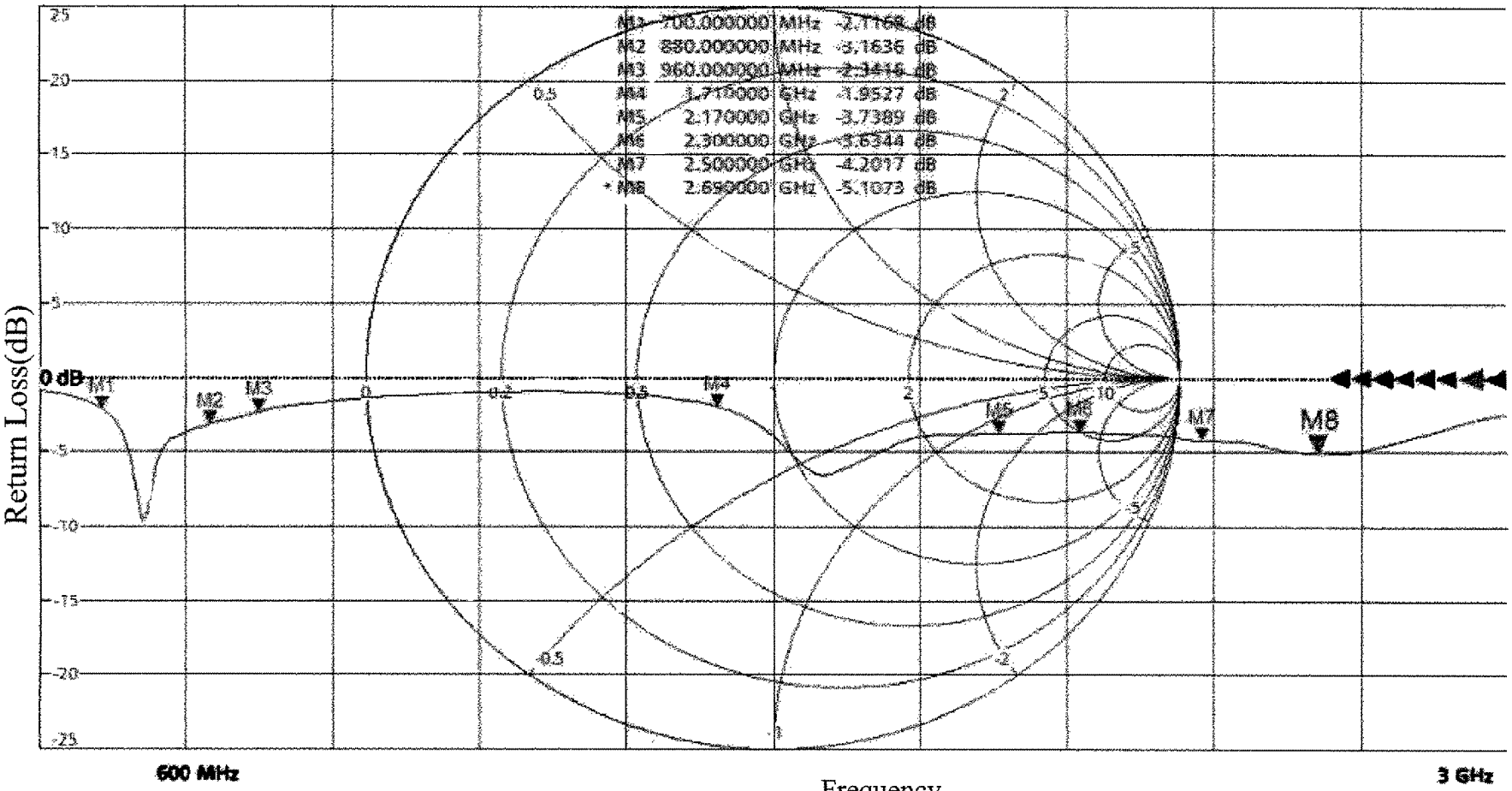
FIG. 9 is a return loss graph of an antenna system according to the present disclosure in state 6.
Figure 10:
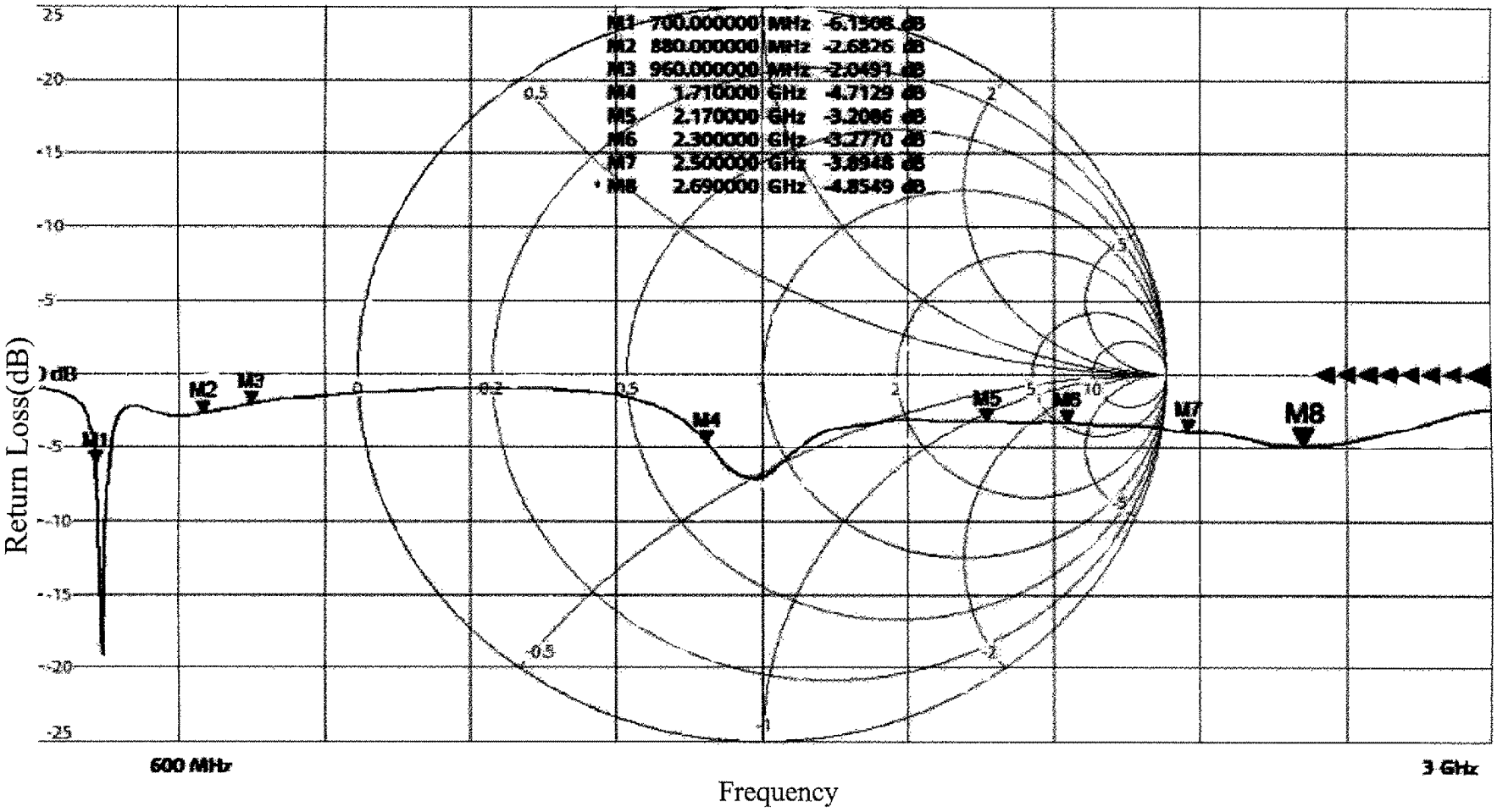
FIG. 10 is a return loss graph of an antenna system according to the present disclosure in state 7.

As can be seen from the above Table 1, operating bands of the antenna system 100 can be switched simply by tuning the capacitance of the tunable capacitor 22. That is, the antenna system 100 can operate in different bands by selecting different states. Refer to FIGS. 4-10 for return loss of the antenna system 100 in states 1-7 and refer to FIG. 3 for efficiency.

In fact, the tunable capacitor 22 has various states, and the antenna system 100 provided by the present disclosure may have 32 different states, as shown in Table 2.

TABLE 2

| DVC Value | State | Capacitance (pF) |
|---|---|---|
| 0x00 | 0 | 0.75 |
| 0x01 | 1 | 0.83 |
| 0x02 | 2 | 0.9 |
| 0x03 | 3 | 0.98 |
| 0x04 | 4 | 1.05 |
| 0x05 | 5 | 1.13 |
| 0x06 | 6 | 1.2 |
| 0x07 | 7 | 1.28 |

TABLE 2-continued

| DVC Value | State | Capacitance (pF) |
|---|---|---|
| 0x08 | 8 | 1.36 |
| 0x09 | 9 | 1.43 |
| 0x0A | 10 | 1.51 |
| 0x0B | 11 | 1.58 |
| 0x0C | 12 | 1.66 |
| 0x0D | 13 | 1.74 |
| 0x0E | 14 | 1.81 |
| 0x0F | 15 | 1.89 |
| 0x10 | 16 | 1.96 |
| 0x11 | 17 | 2.04 |
| 0x12 | 18 | 2.11 |
| 0x13 | 19 | 2.19 |
| 0x14 | 20 | 2.27 |
| 0x15 | 21 | 2.34 |
| 0x16 | 22 | 2.42 |
| 0x17 | 23 | 2.49 |
| 0x18 | 24 | 2.57 |
| 0x19 | 25 | 2.65 |
| 0x1A | 26 | 2.72 |
| 0x1B | 27 | 2.8 |
| 0x1C | 28 | 2.87 |
| 0x1D | 29 | 2.95 |
| 0x1E | 30 | 3.02 |
| 0x1F | 31 | 3.1 |

As can be seen from Table 2, the tunable capacitor 22 can select the operating state of the antenna system 100 simply by changing the capacitance. Without doubt, the number of the states of the antenna system 100 is not limited to 7 in the present disclosure, and in other embodiments, different capacitances and different numbers of states may be selected.

The present disclosure also provides a mobile terminal, and the mobile terminal includes the antenna system 100 described above.

Compared with the related art, the antenna system 100 provided by present disclosure, by providing the tunable capacitor 22 as a tuner of the antenna system 100, not only can achieve that the radiation frequency of the antenna system 100 covers 790-960 MHz and 1710-2690 MHz, but also has good radiation performance.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. An antenna system, comprising:

a metal housing comprising a radiation frame and a grounded back shell spaced apart from the radiation frame;

a circuit board located in the metal housing and comprising a radio frequency feeding source and a tunable capacitor; and an antenna unit connected to the radio frequency feeding source and configured to be coupled to the radiation frame, wherein a fracture is formed between each of two ends of the radiation frame and the grounded back shell, and the tunable capacitor is connected to the radiation frame so as to change an electrical length of the antenna system by switching to different capacitances;

the antenna unit is spaced apart from the radiation frame.

2. The antenna system as described in claim 1, wherein a radiation frequency of the antenna system covers 790-960 MHz and 1710-2690 MHz.

3. The antenna system as described in claim 1, wherein the tunable capacitor has a capacitance ranging from 0.75 pF to 3.1 pF.

4. The antenna system as described in claim 1, wherein the radiation frame is connected to the grounded back shell by a connecting rib.

5. A mobile terminal, comprising the antenna system as described in claim 1.

6. The mobile terminal as described in claim 5, wherein a radiation frequency of the antenna system covers 790-960 MHz and 1710-2690 MHz.

7. The mobile terminal as described in claim 5, wherein the tunable capacitor has a capacitance ranging from 0.75 pF to 3.1 pF.

8. The mobile terminal as described in claim 5, wherein the radiation frame is connected to the grounded back shell by a connecting rib.

* * * * *